US005947210A

United States Patent [19]

Sasaki et al.

[11] Patent Number: 5,947,210

[45] Date of Patent: Sep. 7, 1999

[54] POWER SCREWDRIVER

[75] Inventors: Katsuhiko Sasaki; Tomohiro Ukai, both of Anjo, Japan

[73] Assignee: Makita Corporation, Anjo, Japan

[21] Appl. No.: 09/107,985

[22] Filed: Jun. 30, 1998

[30] Foreign Application Priority Data

Jun. 30, 1997 [JP] Japan ..... 9-174151

[51] Int. Cl.[6] ..... B25B 21/00; B25B 23/14

[52] U.S. Cl. ..... 173/178; 173/216; 192/54.5; 192/150; 227/136

[58] Field of Search ..... 173/178, 213, 173/216, 176; 192/54.5, 34, 150, 56.61; 81/467, 473, 475; 227/136

[56] References Cited

U.S. PATENT DOCUMENTS

| | | | |
|---|---|---|---|
| 5,271,471 | 12/1993 | Sasaki | 173/178 |
| 5,343,961 | 9/1994 | Ichikawa | 173/178 |
| 5,372,206 | 12/1994 | Sasaki et al. | 81/473 |
| 5,458,206 | 10/1995 | Bourner et al. | 173/178 |
| 5,538,089 | 7/1996 | Sanford | 192/54.5 |
| 5,568,849 | 10/1996 | Sasaki et al. . | |
| 5,687,624 | 11/1997 | Tsuge et al. . | |

FOREIGN PATENT DOCUMENTS

| | | |
|---|---|---|
| 4208715 | 3/1992 | Germany . |
| 5337837 | 12/1993 | Japan . |

*Primary Examiner*—Scott A. Smith
*Attorney, Agent, or Firm*—Dennison, Meserole, Scheiner & Schultz

[57] ABSTRACT

A power screwdriver has a tool body, a motor, a drive member rotatably driven by the motor, a spindle rotatably mounted on the tool body and a clutch mechanism provided between the drive member and the spindle. The clutch mechanism includes an engaging clutch and a synchronizer device. The synchronizer device is operable to rotate the spindle at a predetermined speed that is substantially equal to or less than the rotational speed of the drive member, prior to connection of the engaging clutch.

9 Claims, 6 Drawing Sheets

POWER SCREWDRIVER

FIELD OF THE INVENTION

The present invention relates to a power screwdriver, and in particular, to a power screwdriver having an improved clutch mechanism for connecting and disconnecting a drive source, such as a motor, and a spindle.

DESCRIPTION OF THE RELATED ART

In general, a power screwdriver has a clutch mechanism for connecting and disconnecting a motor and a spindle. The clutch mechanism includes an engaging clutch that has a first set of motor clutch teeth and a second set of spindle clutch teeth. The spindle is movable in an axial direction relative to a tool body, and a driver bit is mounted on the spindle for engagement with the screw. When the spindle is moved axially in a direction withdrawing into the tool body, the engaging clutch is connected through engagement between the first and second sets of clutch teeth, so that the torque of the motor is transmitted to the spindle.

Thus, the spindle does not rotate prior to connection of the engaging clutch but starts to rotate only after the engaging clutch is connected.

When the engaging clutch is connected, the first set of motor clutch teeth engages the non-rotating second set of spindle clutch teeth. Therefore, a substantial damaging impact is applied to the second set of spindle clutch teeth. As a result, the clutch teeth are rapidly worn and the durability of the clutch mechanism usually is short.

SUMMARY OF THE INVENTION

The present invention provides a power screwdriver having an improved clutch mechanism including an engaging clutch, which clutch mechanism reduces the damaging impact applied to clutch teeth of the engaging clutch and improves the durability of the engaging clutch.

According to the present invention, a power screwdriver is provided, comprising:

a tool body;

a drive source;

a drive member rotatably driven by the drive source;

a spindle rotatably mounted on the tool body;

a clutch mechanism provided between the drive member and the spindle;

the clutch mechanism including an engaging clutch and a synchronizer device, the synchronizer device being operable to rotate the spindle at a predetermined speed that is substantially equal to or less than the rotational speed of the drive member, prior to connection of the engaging clutch.

By providing a synchronizer device, the spindle is rotated at the predetermined speed when the engaging clutch is connected, so that clutch teeth of the engaging clutch may not suffer from substantial damaging impact during the connection operation. Therefore, the durability of the engaging clutch can be improved.

In a preferred embodiment, the spindle is axially movable relative to the tool body between a first position where the engaging clutch is connected, and a second position where the engaging clutch is disconnected.

The synchronizer device preferably includes a compression coil spring interposed between the drive member and the spindle for transmission of torque from the drive member to the spindle through frictional contact between the drive member and the spindle.

In order to provide an appropriate frictional force for transmitting torque by utilizing the compression coil spring, preferably one end of the compression coil spring is forcibly fitted on a shaft portion of the drive member, and the other end of the compression spring is forcibly fitted into an axial recess formed in the spindle. To achieve a tight and secure fit, the inner and outer diameter of the compression coil spring as well as the diameter of the shaft portion and the inner diameter of the axial recess are precisely machined.

In addition, the coil spring may have a dual function as a synchronizer and a biasing member for keeping the spindle in the first position where the engaging clutch is disconnected.

A rotation prevention member, such as a rubber plate, preferably is mounted on the tool body for preventing the spindle from rotating when the spindle is in the first position. Thus, when the spindle is in the first position, it contacts the rotation prevention member, so that a frictional resistance that is greater than the frictional force between the compression coil spring and both the drive member and the spindle is produced. As a result, the compression coil spring slips either inside the spindle or around the drive member.

The engaging clutch may be a clutch known as "silent clutch" that includes clutch pins for permitting relative rotation of a first drive clutch member and a second spindle clutch member, so that impact applied to the respective clutch teeth may be further reduced.

The power screwdriver may include a screw feeding device. The screw feeding device has a casing mounted on the tool body and extending substantially in parallel to the spindle. A feeder box is reciprocally movable within the casing. The feeder box has a ratchet mechanism for feeding a screw carrying belt having a plurality of screws carried thereon such that the screws are fed one after another to a position that is directly below the spindle as the feeder box is reciprocally moved.

Additional features, aspects and advantages of the invention will become more fully apparent from the claims and the description when it is read in connection with the drawings.

DETAILED DESCRIPTION OF THE PREFERRED EMBODIMENTS

Figure 1:
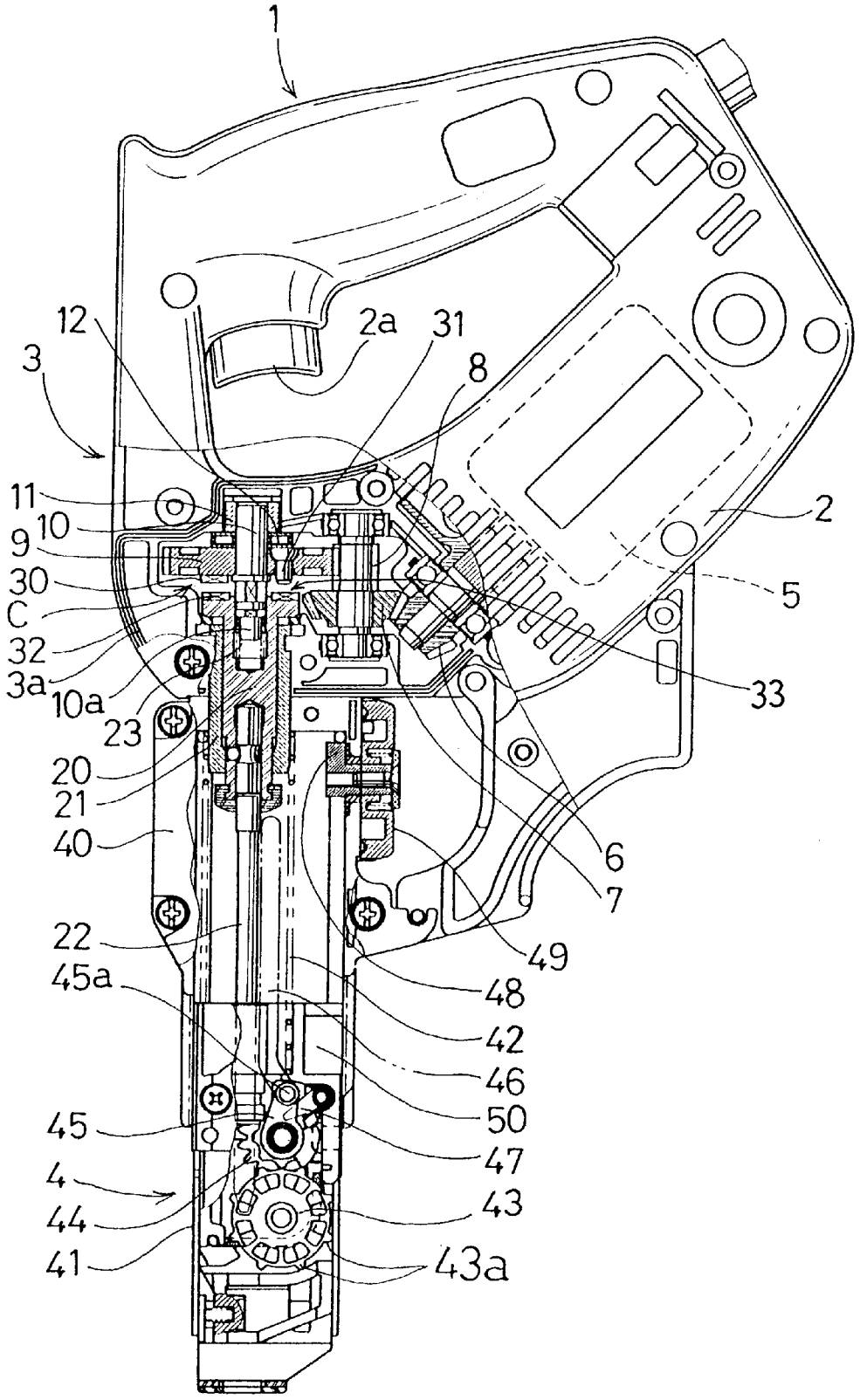
FIG. 1 is a side view, with an inner portion exposed, of a power screwdriver according to an embodiment of the present invention.

Preferred embodiments of the present invention will now be described with reference to the drawings. A power screwdriver 1 is generally shown in FIG. 1 and includes a clutch mechanism C. The power screwdriver 1 has a tool body 3 that includes a substantially D-shaped handle 2. A screw feeding device 4 is mounted on the lower portion of the tool body 3.

Figure 2:
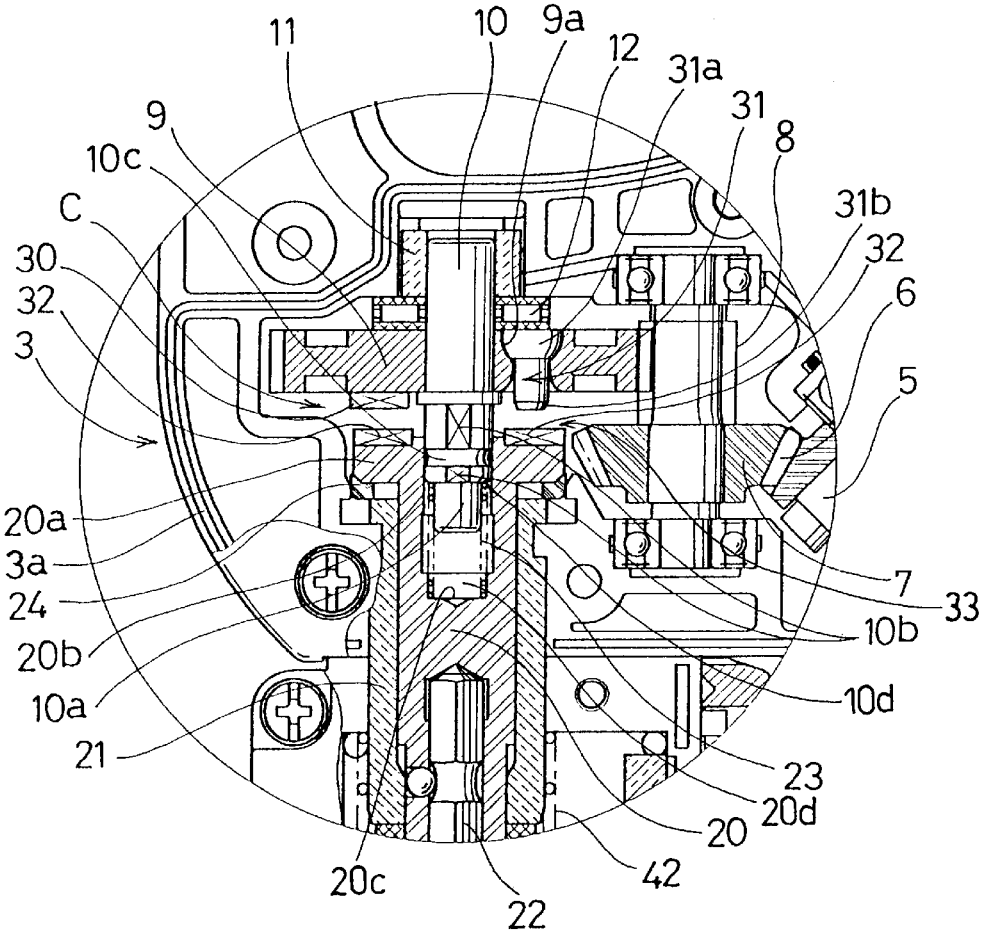
FIG. 2 is an enlarged view of the pertinent parts of the power screwdriver and showing an engaging clutch in a disengaged state.
Figure 3:
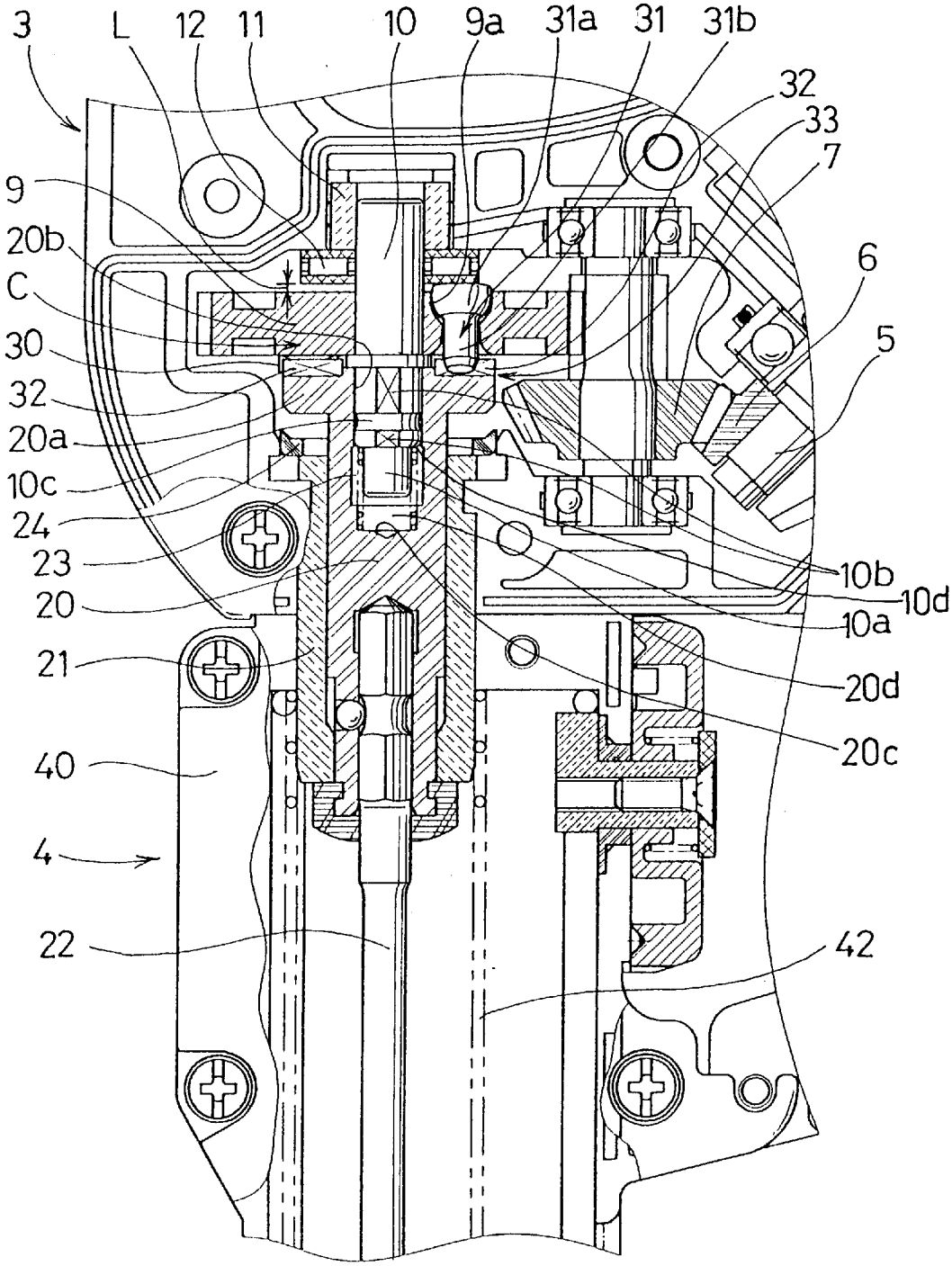
FIG. 3 is an enlarged view of the pertinent parts of the power screwdriver and showing the engaging clutch in an engaged state.

A motor 5 is disposed within the tool body 3. A trigger 2*a* is mounted on the D-shaped handle 2 and is operable by an operator for starting the motor 5. The torque generated by the motor 5 is transmitted to a drive gear 9 via a pinion 6, a bevel gear 7 and an intermediate gear 8. As best shown in FIGS. 2 and 3, the drive gear 9 has a support shaft 10 fixedly mounted thereon. The upper portion of the support shaft 10 is rotatably and axially movably supported by a radial bearing 11, which is mounted on the tool body 3. The lower portion of the support shaft 10 is rotatably inserted into a spindle 20. A thrust bearing 12 is interposed between the radial bearing 11 and the drive gear 9. The support shaft 10 is also slidably movable relative to the thrust bearing 12. The clutch mechanism C is provided between the drive gear 9 and the spindle 20.

Figure 4:
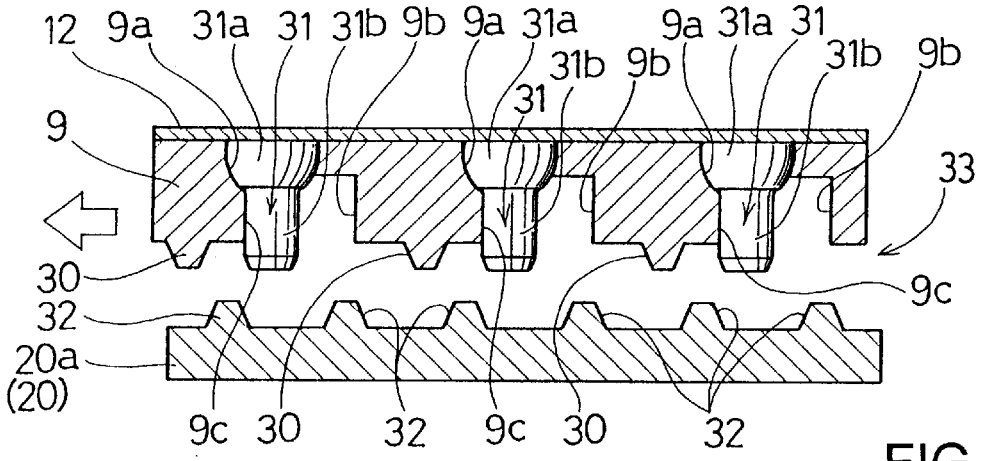
FIG. 4 is a view in developed form of the engaging clutch and showing drive gear clutch teeth and spindle clutch teeth of the engaging clutch in the disengaged state.
Figure 5:
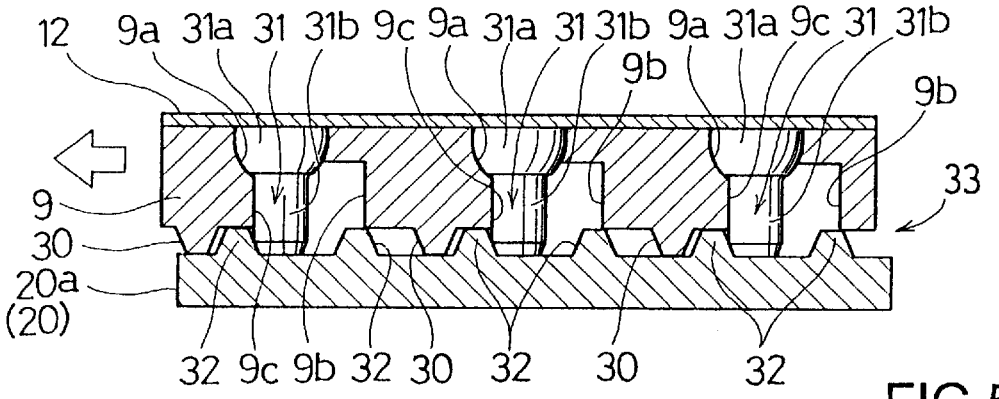
FIG. 5 is a view similar to FIG. 4 but showing the drive gear clutch teeth and the spindle clutch teeth of the engaging clutch in the state when the spindle abuts the drive gear prior to engagement of the engaging clutch.
Figure 6:
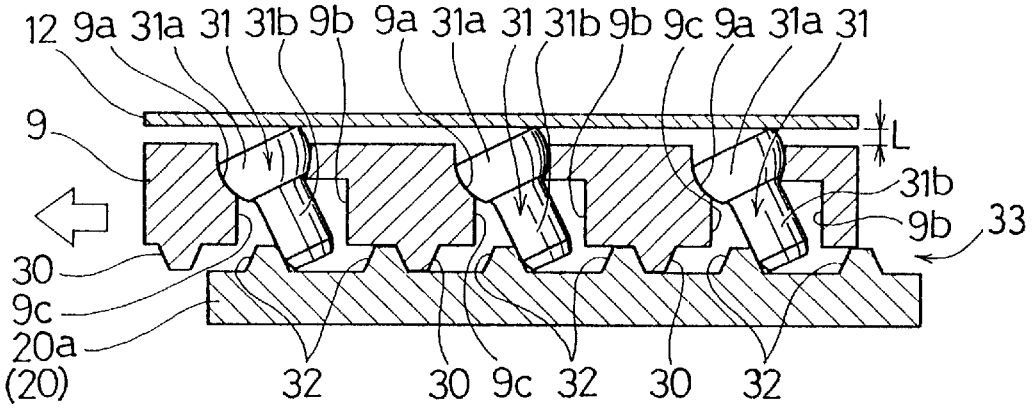
FIG. 6 is a view similar to FIG. 4 but showing the drive gear clutch teeth and the spindle clutch teeth in an engaged state while clutch pins are pivoted from an upright position to a pivoted position.
Figure 7:
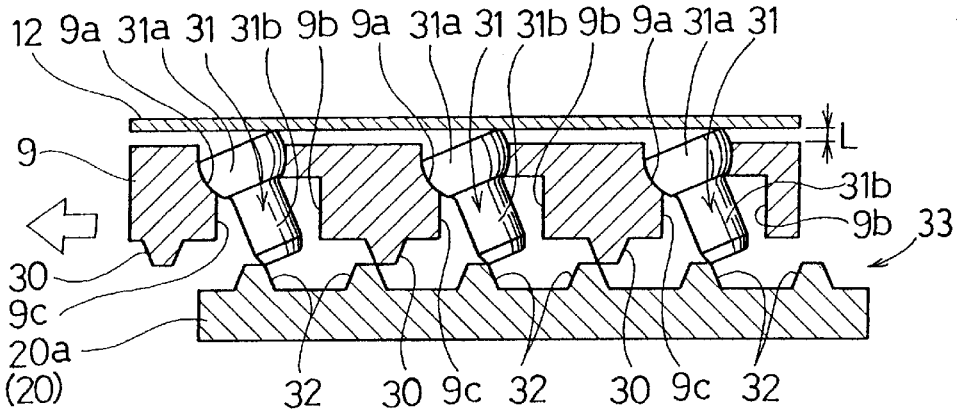
FIG. 7 is a view similar to FIG. 4 but showing the drive gear clutch teeth and the spindle clutch teeth wherein the two sets of clutch teeth have begun to move away from each other.

As shown in FIGS. 4 to 8, the drive gear 9 has a plurality of clutch teeth 30 formed on its lower surface. The clutch teeth 30 preferably are equally spaced from each other in a circumferential direction of the drive gear 9. Clutch pins 31 are positioned between each two adjacent clutch teeth 30 and are pivotable relative to the drive gear 9 in a direction opposite to the rotational direction of the drive gear 9 indicated by an arrow in FIGS. 4 to 8. Each of the clutch pins 31 has a substantially hemispherical head 31*a* and a cylindrical shank 31*b* extending downwardly from the head 31*a*. The head 31*a* is pivotally and slidably received within a support hole 9*a* formed in the upper portion of the drive gear 9. An insertion hole 9*c* is formed in the lower portion of the drive gear 9 and is in communication with the support hole 9*c*. A recess 9*b* is formed in the lower portion of the drive gear 9 and is in communication with the insertion hole 9*c* on the side opposite to the rotational direction of the drive gear 9, so that the clutch pins 31 can be pivoted in the direction opposite to the rotational direction from an upright position as shown in FIGS. 4 and 5 to a pivoted position as shown in FIGS. 6 and 7.

As shown in FIGS. 2, 4, 5 and 8, the upper surface of the head 31*a* of each clutch pin 31, that is in the upright position, is substantially flush with the upper surface of the drive gear 9. In the state shown in these figures, the upper surface of the drive gear 9 contacts the thrust bearing 12. On the other hand, when each clutch pin 31 is in the pivoted position as shown in FIGS. 3, 6 and 7, an upper corner portion of the head 31*a* extends upwardly from the upper surface of the drive gear 9 and contacts the thrust bearing 12, so that a gap L is formed between the drive gear 9 and the thrust bearing 12. The operation of the clutch pin 31 will be described later in connection with the operation of the clutch mechanism C.

As shown in FIGS. 2 and 3, a substantially lower half portion of the support shaft 10 extends downwardly below the drive gear 9 and is substantially closely but axially slidably inserted into an axial recess 20*b* formed in the upper portion of the spindle 20.

A reduced diameter portion 10*a* is formed at a lower end of the support shaft 10 in a stepped manner via an annular surface 10*d*. A compression coil spring 23 is interposed between the annular surface 10*d* and a bottom 20*c* of the axial recess 20*b*, so that the support shaft 10 and the spindle 20 are biased in opposite directions away from each other. The biasing force applied to the support shaft 10 forces the drive gear 5 to be pressed against the thrust bearing 12. Therefore, the clutch pins 31 of the clutch mechanism C are normally held in the upright position by the biasing force of the coil spring 23.

The upper end of the coil spring 23 is forcibly fitted on the reduced diameter portion 10*a* of the support shaft 10, so that a predetermined frictional resistance is produced against the rotation of the coil spring 23 relative to the support shaft 10. The axial recess 20*b* has a bottom part 20*d* that forms the bottom 20*c* described above and that has a diameter smaller than the remaining part of the axial recess 20*b*. The diameter of the bottom part 20*d* is determined to be substantially equal to the diameter of the reduced diameter portion 10*a* of the support shaft 10. Thus, the lower end of the coil spring 23 is forcibly fitted into the bottom part 20*d*, so that a predetermined frictional resistance is produced against the rotation of the coil spring 23 relative to the spindle 20.

In order to provide an appropriate frictional resistance, the inner and outer diameter of the coil spring 23 as well as the diameter of the reduced diameter portion 10*a* of the support shaft 10 and the bottom part 20*d* of the axial recess 20*b* are precisely determined.

With this construction, if there is no obstacle against rotation of the spindle 20, the spindle 20 is free to rotate with the support shaft 10 by means of the coil spring 23 that has a resiliency against torsion applied thereto.

On the other hand, if the spindle 20 is prevented from rotating by means of a stopper 24 as will be explained later, or if the spindle 20 has a resistance force against rotation applied against it, that is greater than the frictional force between the coil spring 23 and the reduced diameter portion 10*a* or the bottom part 20*d*, the coil spring 23 may slip against the reduced diameter portion 10*a* or the bottom part 20*d*. As a result, the spindle 20 may not rotate with the support shaft 10.

The lower half of the support shaft 10 includes two chamfered portions 10*b* that are positioned above the reduced diameter portion 10*a* and that are spaced from each other in the axial direction of the support shaft 10. In addition, an annular groove 10*c* is formed between the chamfered portions 10*b*. By providing the chamfered portions 10*b* and the annular groove 10*c*, lubrication oil that was supplied to the outside of the axial recess 20*b* may easily flow into the axial recess 20*b*. With this lubrication, the frictional connection between the support shaft 10 and the spindle 20 can be reliably and suitably maintained. In addition, the compression spring 23 can smoothly slip relative to the support shaft 10 or relative to the spindle 20 when the spindle 20 is prevented from rotation.

As shown in FIGS. 2 and 3, the spindle 20 has a flange portion 20*a* formed on its upper end. Clutch teeth 32 are formed on an upper surface of the flange portion 20*a* and are equally spaced from each other in the circumferential direction as shown in FIGS. 4 to 8. In this preferred example, the pitch of the clutch teeth 32 is set to be equal to the pitch between the clutch teeth 30 and its adjacent clutch pin 31 in the inclined position of the drive gear 9. The clutch teeth 32 cooperate with the clutch teeth 30 and the clutch pins 31 to form an engaging clutch 33 of the clutch mechanism C.

The spindle 20 is rotatable and axially movably received within a sleeve 21 that is fixedly mounted on a housing 3*a* of the tool body 3. An annular stopper 24 preferably made of rubber is secured to the upper surface of the sleeve 21 and is opposite of the flange portion 20*a* of the spindle 20. As previously described, the spindle 20 is biased by the coil spring 23 in the direction away from the drive gear 9. Therefore, the flange portion 20*a* is normally held to contact the stopper 24, so that the spindle 20 is prevented from rotating by the frictional force between the flange portion 20*a* and the stopper 24.

The compression coil spring 23 serves as a synchronizer device for rotating the spindle 20 before the engaging clutch 33 of the clutch mechanism C is connected. The operation of the clutch mechanism C including the engaging clutch 33 and the compression coil spring 23 will now be explained.

In the state shown in FIG. 4, the flange portion 20*a* of the spindle 20 is held in a position separated from the drive gear 9 by the biasing force of the coil spring 23, so that the clutch teeth 30 and the clutch pins 31 of the drive gear 9 are separated from the clutch teeth 32 of the spindle 20. This state occurs when the tool body 3 of the power screwdriver 1 is not pressed against a workpiece as will be explained later. In this state, the spindle 20 is prevented from rotating through abutment of the flange portion 20*a* with the stopper 24. The drive gear 9 is pressed against the thrust bearing 12 by the biasing force of the coil spring 23, so that the clutch pins 31 are held in the upright position. When an operator pulls the trigger 2*a* to start the motor 5, the drive gear 9 rotates relative to the spindle 20 in the direction indicated by an arrow in FIG. 4.

When the spindle 20 is moved upwardly, the flange portion 20*a* of the spindle 20 is moved away from the stopper 24, so that the spindle 20 becomes free to rotate relative to the sleeve 21 and starts to rotate with the drive gear 9 by the frictional force produced between the coil spring 23 and the support shaft 10 or the spindle 20. In this respect, the coil spring 23 functions as a synchronizer device for rotating the spindle 20 prior to connection of the engaging clutch 33.

Figure 9:
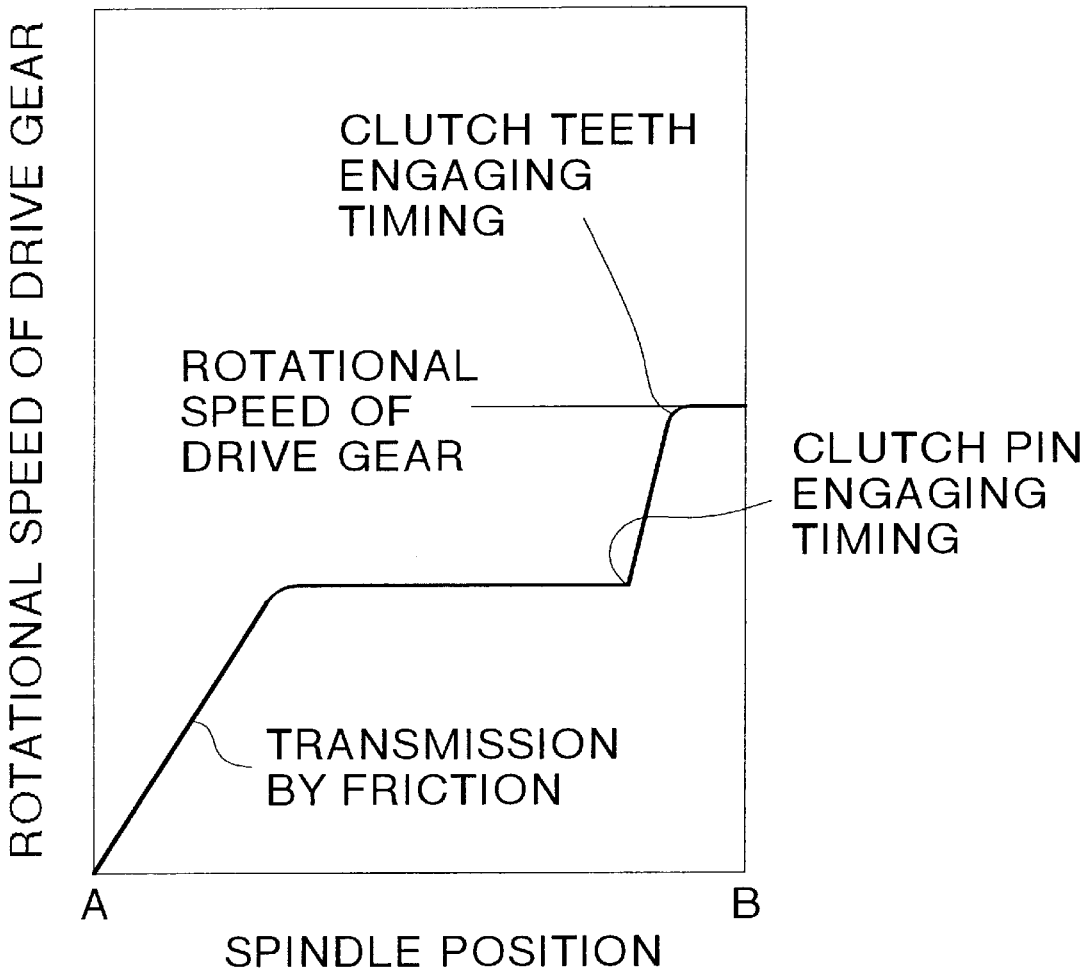
FIG. 9 is a graph showing the relationship between the spindle position and the rotational speed of the spindle.

As the spindle 20 is further moved upwardly, each of the clutch teeth 32 is inserted between the corresponding engaging tooth 30 and its adjacent clutch pin 31 as shown in FIG. 5, so that the spindle 20 abuts the drive gear 9. At this time, the rotational speed of the spindle 20 is still lower than the rotational speed of the drive gear 9. Therefore, the drive gear 9 then advances relative to the spindle 20 in the rotational direction, so that the clutch pins 31 are pivoted in the direction opposite to the rotational direction through abutment the respective clutch teeth 32. After this relative rotation of the drive gear 9 to the spindle 20, the clutch teeth 30 engage the corresponding clutch teeth 32 to directly transmit torque from the drive gear 9 to the spindle 20. As the clutch pins 31 are pivoted, the drive gear 9 is moved downwardly toward the spindle 20 by the distance of the gap L by abutment of the upper corner portions of the clutch pins 31 with the thrust bearing 12 as shown in FIG. 6. Therefore, the clutch teeth 30 can reliably engage the corresponding clutch teeth 32. With the clutch teeth 30 and 32 thus engaged, the screw is driven into the workpiece. FIG. 9 shows the relationship between the position and the rotational speed of the spindle 20. In this figure, position A is a position in which the flange portion 20*a* of the spindle 20 abuts the stopper 24. Position B is a position in which the engaging clutch 33 is completely connected or engaged.

Because the spindle 20 is rotated at a predetermined speed when the engaging clutch 33 is connected (when the clutch teeth 30 engage the corresponding clutch teeth 32 after the clutch pins 31 engage the corresponding clutch teeth 32), damaging impact that may be produced between the clutch teeth 30 and the clutch teeth 32 can be greatly reduced in comparison with damaging impact that may be produced when the spindle 20 is not rotated prior to engagement of the engaging clutch 33. Therefore, the durability of the clutch pins 31 and the clutch teeth 30 and 32 can be greatly improved.

Figure 8:
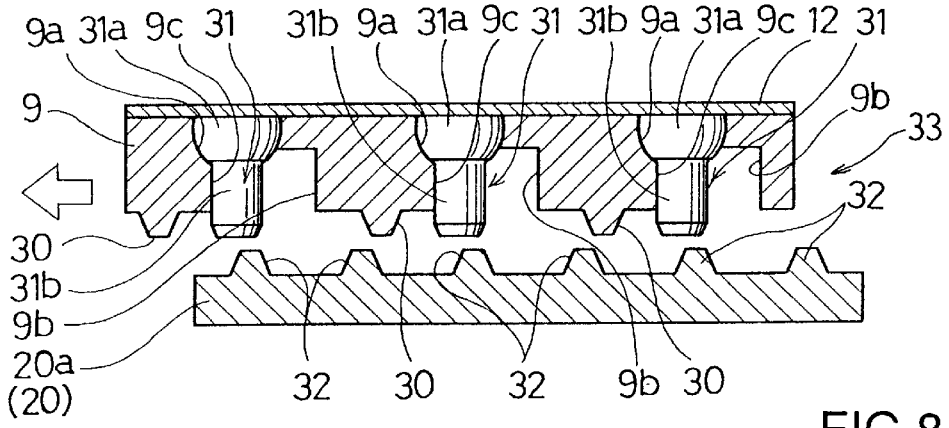
FIG. 8 is a view similar to FIG. 4 but showing the drive gear clutch teeth and the spindle clutch teeth, which are separated from each other while the clutch pins are returned to the upright position.

After the screw is completely driven into the workpiece, the operator releases the pressing force applied to the tool body 3, so that the spindle 20 is moved downwardly relative to drive gear 9 by the biasing force of the compression coil spring 23. As a result, the engagement between the clutch teeth 32 and the clutch teeth 30, as well as the clutch pins 31, becomes shallower as shown in FIG. 7. Consequently, the clutch teeth 32 are disengaged from the clutch pins 31 and the clutch teeth 30. Immediately after the clutch teeth 32 are disengaged from the clutch pins 31, the clutch pins 32 return to the upright position as shown in FIG. 8 by the biasing force of the compression coil spring 23. Thus, a substantial gap is produced between the clutch teeth 32 and the clutch teeth 30 as well as the clutch pins 31 immediately after disengagement of the clutch teeth 32 from the clutch pins 31. As a result, the clutch mechanism C becomes idle and does not produce any unpleasant impact sounds. The engaging clutch 33 incorporating the clutch pins 31 described above is known as a silent clutch.

Returning to FIG. 1, a driver bit 22 for engagement with a screw is attached to the lower end of the spindle 20 and extends downwardly from the spindle 20 into the screw feeding device 4.

The screw feeding device 4 serves to intermittently feed a screw carrying belt (not shown) by a distance of one pitch of the screws carried on the screw carrying belt such that each screw is positioned directly below the driver bit 22 when the spindle 20 is moved downwardly.

The construction of the screw feeding device 4 will be briefly described. A casing 40 is mounted on the lower end of the tool body 3 so as to enclose the sleeve 21 therein. The casing 40 extends in parallel to the axis of the sleeve 21 or the spindle 20. A feeder box 41 is vertically movably fitted within the casing 40. A compression coil spring 42 is interposed between an upper closed end of the casing 40 and the feeder box 41, so that the feeder box 41 is normally biased in a direction to extend downwardly from the casing 40. A stopper member (not shown) is provided on the casing 40 to limit the lower stroke end of the feeder box 41.

The feeder box 41 includes a ratchet wheel 43, an intermediate gear 44, a ratchet arm 45 and a detent claw 47. The intermediate gear 44 engages a gear part (not shown) of the ratchet wheel 43. The ratchet arm 45 engages the intermediate gear 44 only when the intermediate gear 44 rotates in a counterclockwise direction as viewed in FIG. 1. The detent claw 47 prevents the intermediate gear 44 from rotating in a clockwise direction as viewed in FIG. 1. The ratchet arm 45 has one end on which a guide roller 45*a* is rotatably mounted. The guide roller 45*a* engages a guide slot 46 formed in one lateral wall of the casing 40. The guide slot 46 has a straight portion that extends in the longitudinal direction of the casing 40 or in parallel to the axial direction of the spindle 20. The guide slot 46 has a lower end inclined downwardly and leftwardly from the straight portion as viewed in FIG. 1.

The feeder box 41 has a lower end for abutment with a workpiece into which a screw is driven. When an operator presses the tool body 3 downwardly onto the workpiece while grasping the handle 2, or when the feeder box 41 is pressed onto the workpiece against the biasing force of the coil spring 42, the feeder box 41 is moved upwardly relative to the casing 40. At the same time, the guide roller 45*a* of the ratchet arm 45 moves upwardly along the guide slot 46 from the inclined lower end into the straight portion, so that the ratchet arm 45 pivots by a predetermined angle in the counterclockwise direction. Then, the intermediate gear 44 rotates by the same angle and in the same direction as the ratchet arm 45, and the ratchet wheel 43 rotates in the clockwise direction. The ratchet wheel 43 has a plurality of claws 43*a* that are formed on its outer periphery and are equally spaced from each other in the circumferential direction. The screw carrying belt has a plurality of engaging slots for engagement with the claws 43*a* of the ratchet wheel 43. The engaging slots are arranged in series in the longitudinal direction of the screw carrying belt and are spaced from each other by the same pitch as the claws 43*a* of the ratchet wheel 43. As a result, the screw carrying belt is fed leftwardly as viewed in FIG. 1 by a distance corresponding to one pitch of the screws carried thereon, so that the next screw to be driven is positioned directly below the driver bit 22.

When the guide roller 45*a* enters the straight portion of the guide slot 46, the ratchet arm 45 no longer pivots, so that the screw to be driven is held at a position directly below the driver bit 22. As the feeder box 41 is further moved upwardly relative to the tool body 3, the lower end of the driver bit 22 abuts the screw to be driven and then forces this screw to be removed from the screw carrying belt. Immediately after that, the removed screw abuts the workpiece, so that the spindle 20 as well as the driver bit 22 is moved upwardly against the biasing force of the coil spring 23.

As previously explained, when the spindle 20 is moved upwardly, the flange portion 20*a* is moved away from the stopper 24, so that the spindle 20 is rotated with the drive gear 9 by means of the coil spring 23 as a synchronizer device. As the spindle 20 is further moved upwardly, the engaging clutch 33 is connected, so that the rotational torque is directly transmitted from the drive gear 9 to the spindle 20 and subsequently to the driver bit 22 for driving the screw into the workpiece.

As the operator further presses the tool body 3 against the workpiece, the feeder box 41 is further moved upwardly relative to the casing 40, so that the screw is further driven into the workpiece. Upon completion of the screw driving operation, the operator releases the pressing force applied to the tool body 3, so that the feeder box 41 returns to move downwardly relative to the casing 40 by the biasing force of the compression coil spring 42. As the feeder box 41 is moved downwardly, the guide roller 45, which engages the straight portion of the guide slot 46, moves from the straight portion to the lower inclined portion of the guide slot 46, so that the ratchet arm 45 is pivoted inversely in the clockwise direction as viewed in FIG. 1. However, because the intermediate gear 44 is prevented from rotating in its reverse direction by the detent claw 47, the intermediate gear 44 does not rotate with the ratchet arm 45.

With the above operation, the screw feeding device 4 feeds the screw carrying belt such that the screws carried on the screw carrying belt are moved one after another to the position directly below the driver bit 22 during each reciprocal movement of the feeder box 41. Therefore, the operator can perform a continuous screw driving operation without need for a manual screw setting operation.

In the meantime, the screw feeding device 4 further includes a rotatable stopper cam 48 that has a diameter varying in the rotational direction. A stopper plate 50 is mounted on the upper portion of the feeder box 41 for abutment with the stopper cam 48. Thus, the upper stroke end of the feeder box 41 is limited through abutment of the stopper plate 50 with the stopper cam 48. The operator can rotate the stopper cam 48 by means of an adjusting dial 49, so that a fine adjustment of the stroke of the feeder box 41 can be performed. A fine adjustment of the driving depth of the screw also can be performed.

As described above, according to the power screwdriver 1 of this embodiment, when the tool body 3 is pressed against the workpiece, the spindle 20 is moved upwardly, so that the flange portion 20*a* of the spindle 20 is moved away from the stopper 24. Then, the spindle 20 starts to rotate by action of the compression coil spring 23, which serves as a synchronizer device. When the clutch teeth 32 of the spindle 20 are brought into engagement with the clutch pins 31 and the clutch teeth 30 of the drive gear 9, the spindle 20 is rotated at a predetermined speed that is substantially equal to or slightly lower than the rotational speed of the drive gear 9. Therefore, the clutch teeth 32 of the spindle 20 can smoothly engage the clutch pins 31 and the clutch teeth 30. As a result, the durability of parts within the clutch mechanism C, and in particular the durability of the clutch pins 31, can be greatly improved.

As shown in FIG. 9, in this embodiment, the rotational speed of the spindle 20 abruptly increases immediately after the spindle 20 is moved away from the stopper 24. However, the rotational speed of the spindle 20 does not increase to reach the rotational speed of the drive gear 9 but becomes to have a substantially constant value that is lower than the rotational speed of the drive gear, because of balance between the frictional force produced by the compression coil spring 23 and the slip caused at the compression coil spring 23*a*.

With regard to the function of the coil spring 23, this biases the spindle 20 and the driver gear 9 away from each other or normally maintains the clutch mechanism C in a disconnected state. A coil spring having such a function is usually incorporated in this kind of a clutch mechanism. In the above embodiment, however, the coil spring 23 not only has this function but also functions as a synchronizer device. Therefore, by incorporating the coil spring 23 having such a dual function, the above operation and advantages can be attained without incorporating a separate synchronizer device. Therefore, manufacturing costs can be reduced.

In other respect, in order to rotate the spindle 20 prior to the connection of the engaging clutch 33 of the clutch mechanism C, a synchronizer device can be incorporated independently of a coil spring that serves to keep the engaging clutch 33 disconnected.

Although in the above embodiment the coil spring 23 (as a synchronizer device) is incorporated into the power screwdriver 1 having the engaging clutch 33 (also known as a silent clutch), such a synchronizer device may be incorporated into a power screwdriver having a simple engaging clutch that transmits torque only by engagement between clutch teeth.

While the invention has been described with reference to preferred embodiments thereof, it is to be understood that modifications or variations may be easily made without departing from the spirit of this invention which is defined by the appended claims.

What is claimed is:

1. A power screwdriver, comprising:

a tool body;

drive means;

a drive member rotatably driven by said drive means;

a spindle rotatably mounted on said tool body;

clutch means provided between said drive member and said spindle;

said clutch means including an engaging clutch and a synchronizer device, said synchronizer device being operable to rotate said spindle at a predetermined speed that is substantially equal to or less than the rotational speed of said drive member, prior to connection of said engaging clutch.

2. The power screwdriver as defined in claim 1 wherein said spindle is movable in an axial direction between a first position and a second position, said engaging clutch being disengaged and engaged when said spindle is in said first position and said second position, respectively.

3. The power screwdriver as defined in claim 2 wherein:

said synchronizer device comprises a friction transmission member for transmitting torque from said drive member to said spindle by a frictional force; and the power screwdriver further including means for preventing rotation of said spindle against the frictional force applied by said friction transmission member when said spindle is in said first position.

4. The power screwdriver as defined in claim 3 wherein said drive member and said spindle are opposed to each other in an axial direction, said friction transmission member comprises a compression coil spring axially disposed between said drive member and said spindle, said compression coil spring has a first end and a second end for frictionally contacting said drive member and said spindle, respectively.

5. The power screwdriver as defined in claim 4 wherein said compression coil spring serves to normally keep said spindle in said first position.

6. The power screwdriver as defined in claim 4 wherein:

said spindle has an axial recess formed on the side of said drive member, said axial recess having a bottom;

said drive member has a shaft portion extending into said axial recess, said shaft portion having an annular seat surface and a reduced diameter part extending from said seat surface;

said first end of said compression coil spring contacts said seat surface and is frictionally fitted on said reduced diameter part; and said second end of said compression coil spring contacts said bottom of said axial recess and is frictionally fitted into a hole part of said axial recess adjacent to said bottom.

7. The power screwdriver as defined in claim 3 wherein said preventing means comprises a prevention member secured to said tool body for frictionally contacting said spindle when said spindle is in said first position, said prevention member providing a frictional force to said spindle, which frictional force is greater than a frictional force produced between said prevention member and said spindle when said spindle is in said first position, so that said frictional transmission member slips relative to at least one of said spindle and said drive member.

8. The power screwdriver as defined in claim 1 wherein said engaging clutch includes first and second clutch teeth and clutch pins, said first clutch teeth and said clutch pins being provided on one of said drive member and said spindle, and said second clutch teeth being provided on the other, said clutch pins being positioned between each two adjacent first clutch teeth and each being pivotable between an upright position and an inclined position in the circumferential direction, so that said second clutch teeth abut respective said clutch pins so as to pivot said clutch pins from said upright position to said inclined position prior to engagement with respective said first clutch teeth.

9. The power screwdriver as defined in claim 1, further including screw feeding means that comprises:

a casing mounted on said tool body and extending substantially in parallel to said spindle;

a feeder box reciprocally movable within said casing; and means for feeding a screw carrying belt having a plurality of screws carried thereon such that the screws are fed one after another to a position that is directly below said spindle as said feeder box is reciprocally moved.

* * * * *